United States Patent [19]

Campbell et al.

[11] 4,085,875

[45] Apr. 25, 1978

[54] RECORD CARRIER

[76] Inventors: Louis Campbell, 1503 Meadowview La., Martinsville, Va. 24112; Edward G. Keshock, 1625 Kingsway Rd., Norfolk, Va. 23518

[21] Appl. No.: 666,757

[22] Filed: Mar. 15, 1976

[51] Int. Cl.[2] ..... B65D 71/00

[52] U.S. Cl. ..... 224/45 K; 206/310; 211/40

[58] Field of Search ..... 224/45 K, 45 R, 48 R, 224/46 R, 455, 58, 28 A, 45 G; 206/486, 310; 16/125, 115; 211/41, 40, 132, 49 R, 128, 14, 129, 78, 131, 163, 144; 108/92

[56] References Cited

U.S. PATENT DOCUMENTS

| | | | |
|---|---|---|---|
| D. 160,688 | 10/1950 | Brock | 211/129 |
| 1,472,508 | 10/1923 | Beckman | 16/115 |
| 1,875,121 | 8/1932 | Olson | 16/125 |
| 2,172,196 | 9/1939 | Flamm | 224/45 K |
| 2,435,698 | 2/1948 | Running | 211/49 R |
| 2,454,858 | 11/1948 | Burt | 211/49 R |
| 2,574,164 | 11/1951 | Baay | 211/131 |
| 2,954,898 | 10/1960 | Freeberg | 224/45 K |
| 3,109,687 | 11/1963 | Derewg | 16/115 |
| 3,161,294 | 12/1964 | Meuche | 211/41 |
| 3,224,655 | 12/1965 | Buchanan et al. | 224/45 K |
| 3,301,451 | 1/1967 | Halverson | 224/45 K |
| 3,545,659 | 12/1970 | Libby | 224/45 R |
| 3,854,577 | 12/1974 | Du Molin | 224/45 R |
| 3,951,079 | 4/1976 | Tolleson | 224/48 R |

*Primary Examiner*—Trygve M. Blix
*Assistant Examiner*—Kenneth Noland
*Attorney, Agent, or Firm*—Watts, Hoffmann, Fisher & Heinke Co.

[57] ABSTRACT

Apparatus for carrying phonographic records in a stacked arrangement. The apparatus has a base, a spindle, and a handle. The handle is movably coupled to the spindle to provide two positions for the handle relative to the spindle. One handle position is employed for carrying the stack and carrier. The other handle position is a storage position which facilitates adding records to, or removing records from the stack without detaching the handle from the spindle. For compactness in shipping and storage, the base and the spindle may be separate pieces, which may be easily assembled and disassembled.

7 Claims, 5 Drawing Figures

RECORD CARRIER

BACKGROUND OF THE INVENTION

1. Field of the Invention

This invention relates to a carrying apparatus for a stack of phonographic records, and more particularly for carrying a stack of 45 RPM records with a relatively large central hole.

2. Prior Art

Record-carrying devices for transporting phonographic records in a vertically-stacked arrangement have been proposed. These proposed record carriers included a flat base and a perpendicular spindle around which records were to be loaded in a stacked arrangement. According to this proposal each record carrier was to be equipped with a carrying handle detachably coupled to the spindle. The handle was to be removed to place records onto, or to remove records from, the stack of records carried around the spindle.

A record-carrier handle should be firmly attached to the upper portion of the spindle and should be sufficiently large to permit the carrying of the loaded assembly. On the other hand, a large-sized handle obstructs access to a record stack disposed around a spindle of only slightly smaller cross-section than the records central aperture. Accordingly, the design of the handle assembly for such a record carrier has been a source of design difficulty in the prior proposals.

To solve this difficulty assemblies with detachable handles have been proposed. Detachable handles require relatively complex and expensive attachments to cooperate with the spindle in order to satisfy the requirements of firm attachment and easy change-over to allow access to the record stack. Such handle assemblies requiring the removal of the handle from the spindle element are undesirable since the separation of the handle from the remaining portions of the record carrier facilitates loss or damage to the handle.

Further, the known record carriers are bulky even when unloaded. Thus, they require a large space and are inefficiently packaged in shipment and storage.

SUMMARY OF THE INVENTION

This invention relates to a novel apparatus and method for carrying and loading phonographic records in a stacked arrangement on a carrying structure which overcomes the foregoing limitations and other disadvantages.

The record carrier of this invention comprises a base, an upwardly extending spindle, and a movable handle portion suitable for carrying the loaded carrier by hand. Phonographic records are carried in a stacked arrangement about the spindle.

The stack of phonographic records can be quickly and easily accessed, that is, either added to or removed from the carrier without the necessity of removing the handle element.

The carrying handle of this invention is not detached during loading or unloading, thus reducing the chances of loss or damage to the handle during the processes of adding or removing of records from the carrier. The preferred spindle is hollow and has an apertured top. The handle is a flexible cord which extends through the spindle aperture and is knotted at each of its ends on each side of the spindle aperture to connect the handle to the spindle. When the handle is not in use the majority of the handle is stored within the spindle to permit a plurality of the carriers to be stacked if desired or to facilitate record access.

A further advantage of the record carrier of one embodiment of this invention is that the base and spindle sections maybe separately manufactured. These sections are quickly and conveniently assembled (or disassembled), at the desire of the user. This improved design provides for compact packaging for shipment, low manufacturing cost, and for easy storage when the record carrier is not in use.

The object of the present invention is to provide a novel and improved carrying apparatus for phonographic records or the like.

Further advantages of the present invention will become apparent from the following detailed description taken in conjunction with the accompanying drawings.

DESCRIPTION OF THE PREFERRED EMBODIMENT

Figure 1:
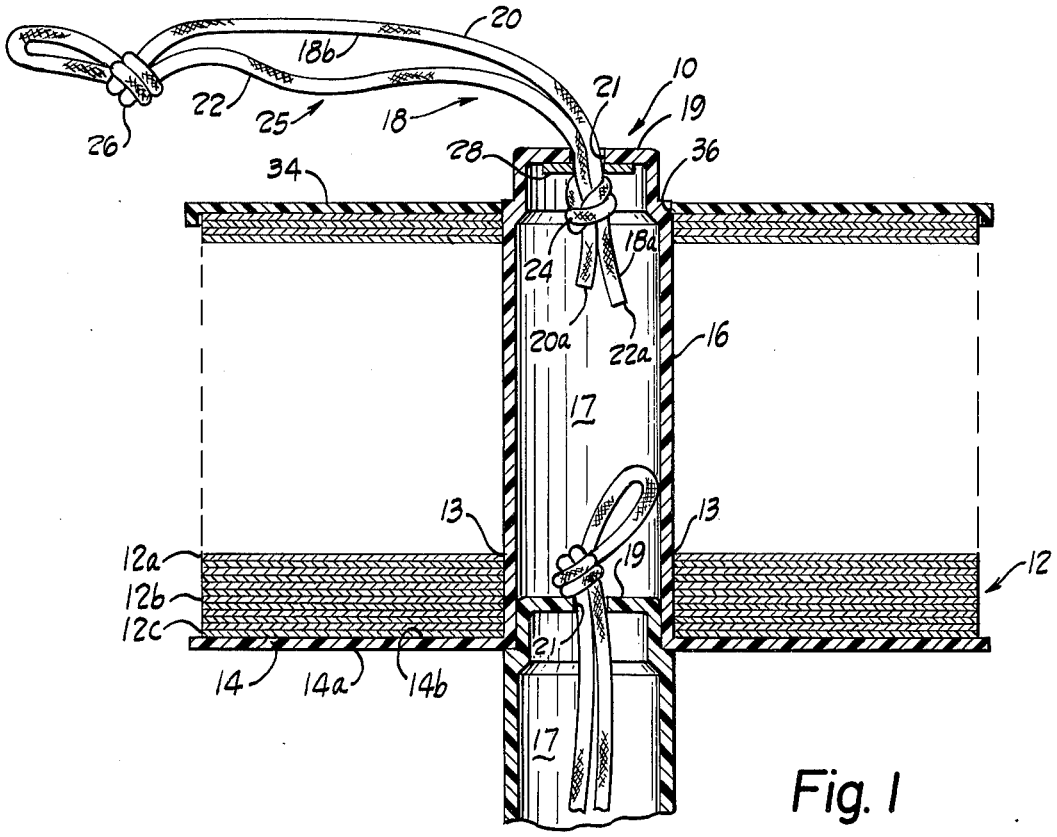
FIG. 1 is a sectional view of the record carrier of the present invention with a stack of records carried thereon and positioned on a second carrier shown in a fragmentary sectional view.
Figure 2:
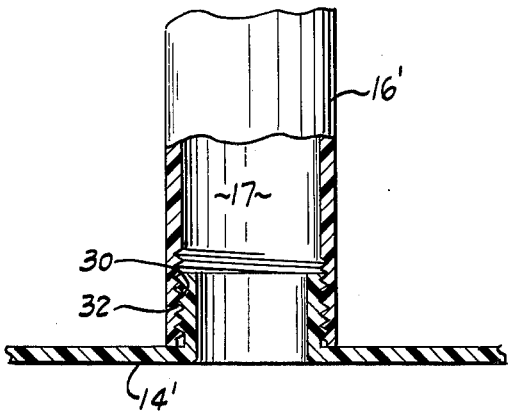
FIG. 2 is a fragmentary sectional view of the connection between the spindle and base of the record carrier in its detachable embodiment.

Referring to FIGS. 1 and 2, a record carrier is shown generally at 10. The record carrier 10 includes a base portion 14, a tubular spindle 16, and a carrying handle shown generally at 18.

A stack 12 of phonographic records is shown carried upon the record carrier. Certain of the records of the stack 12 are designated by the reference characters **12*a*, 12*b*, 12*c*. The spindle 16 projects through central openings 13** in the records.

The base 14 is preferably a flat, disc-like structure. In its preferred embodiment the base 14 is of slightly larger diameter than the records it is designed to carry, to provide protection for the records. The base has lower carrier supporting surfaces **14*a* and upper record supporting surfaces 14*b***.

The spindle 16 is a cylindrical structure of a diameter slightly smaller than the record openings 13 and relatively long height. The spindle 16 extends generally upwardly from the base 14. Thus, the spindle accommodates a relatively substantial stack of records and allows a minimum of shifting about the spindle 16.

The spindle 16 is attached to the base 14. In its preferred embodiment shown in FIG. 1, the spindle 16 and the base 14 are portions of a single, integral molded plastic piece. Alternatively, as shown in FIG. 2, the spindle 16' is formed separately of the base 14' for ease in packaging, storing and shipping in detached, separate pieces. In the embodiment shown in FIG. 2, the spindle 16' is equipped with a set of threads 30 and the base 14' is provided with a threaded projection 32 to cooperate with the threads 30 to effect a disconnectible (but easily connected) attachment of the spindle and base.

The spindle 16 has a hollow center region 17 with a top wall 19. The top wall 19 is solid except for an opening or aperture 21 which extends through the top wall 19 to communicate with the hollow center region 17 within the spindle 16.

Stacking of carriers incorporating features of this invention is facilitated by configuring the projecting end of the spindle and the base as shown in FIG. 1. The projecting end of the spindle is characterized by a stepped periphery. Adjacent the spindle's top wall 19 the spindle diameter is reduced along a relatively short portion of its length in comparison with the spindle diameter over the substantial portion of the spindle length. A radially extending shoulder joins the reduced diameter portion with the larger diameter spindle portion. The reduced diameter portion is dimensioned to mate with an aperture in the base 14. FIG. 1 clearly shows two or more such carriers stacked upon one another with the base 14 of one carrier, at its lower carrying supporting surfaces 14*a*, supported on the spindle shoulder of the spindle of the subjacent or supporting carrier.

The handle 18 extends through the aperture 21 with a portion 18*a* inside the spindle 16 and a portion 18*b* outside the spindle 16. The portion 18*b* is above this top wall 19 and formed in a loop 25. This loop 25 serves as a carrying handle for the record carrier 10.

The handle 18 of the embodiment of FIG. 1 includes cord lengths 20, 22. These lengths 20, 22 are of sturdy, flexible material, such as plastic or textile string or twine. Preferably, the lengths 20, 22 are a single piece, doubled to form a loop 25 with free ends 20*a*, 22*a* coupled to form an inner knot 24. The loop 25 extends through the aperture 21 in the top wall 19 and is tied to form an outer knot 26. The inner knot 24 is disposed within the hollow region 17 of the spindle 16. The two knots 24, 26 are larger than the aperture 21 in the top wall 19 to prevent the entire handle from being drawn through the aperture 21. The handle 18 alternatively is formed of two individual lengths of cord, or a single length; in either case, inner and outer knots secure a portion within the region 17 and a second portion outside the spindle 16.

A portion of handle 18 is drawn downwardly into the spindle 16 for ease in loading and unloading items from the stack 12. The weight of the cord itself and optionally the weight 28, provides a downward retracting force to draw the handle lengths within the spindle. This handle has two positions: one for loading, in which more of the handle 18 is retracted into the hollow portion 17 of the spindle; and a second position where less is within the spindle and more is outside the spindle for ease in carrying the loaded carrier.

An optional dust cover 34 may be used as desired. The dust cover 34 is a flanged disc of a size somewhat larger than the phonographic records 12*a*, 12*b*, 12*c* to be carried and has a central hole 36 through the disc to accommodate the spindle 16 when the dust cover 34 is in place. As shown in FIG. 1, the dust cover permits stacking of one carrier on another without record damage. This carrier stacking may be accomplished when the lower carrier has either a full complement of records, or with less than a full complement of records.

Figure 3:
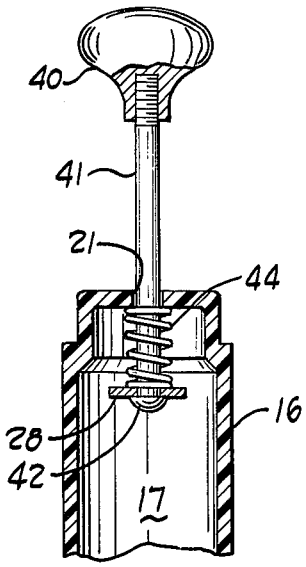
FIG. 3 is a sectional view showing the handle portion for a second embodiment of the handle of the record carrier of this invention.

Another alternate handle is shown in FIG. 3. The alternate handle has a carrying knob 40 threaded onto a stem 41. The stem 41 projects through the top aperture 21 of the spindle 16. The stem 41 includes an enlarged head 42 which may carry the optional weight 28. An optional coil spring 44 is positioned between the top wall 19 and the enlarged head 42 and augments the retracting forces (the weight of handle and the optional weight 28) to bring the carrying handle 18 within the spindle 16 when the assembly is not being carried.

Figure 4:
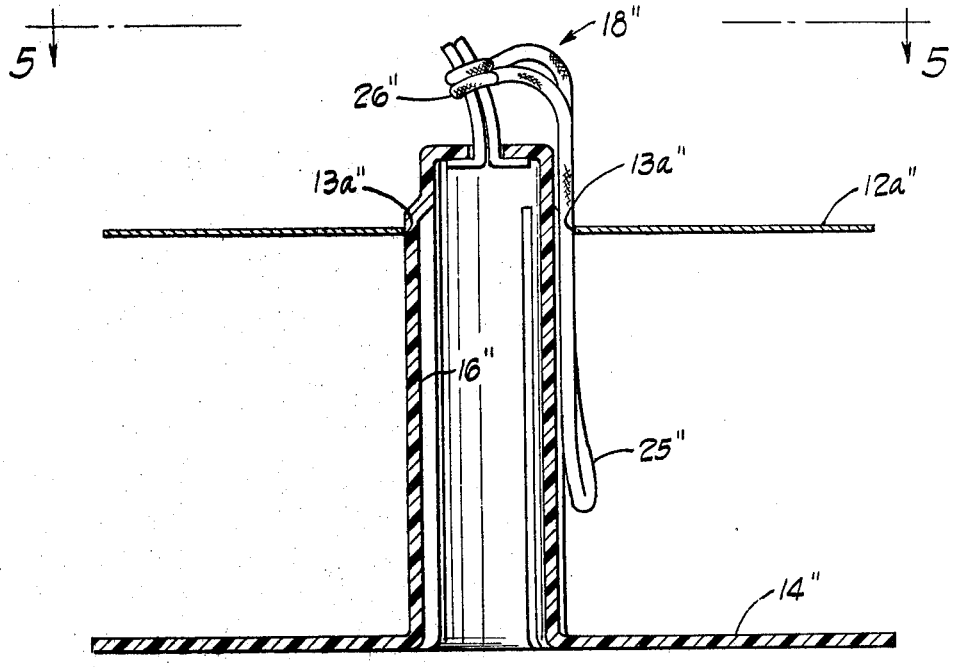
FIG. 4 is a sectional view of an alternate embodiment of the present invention.
Figure 5:
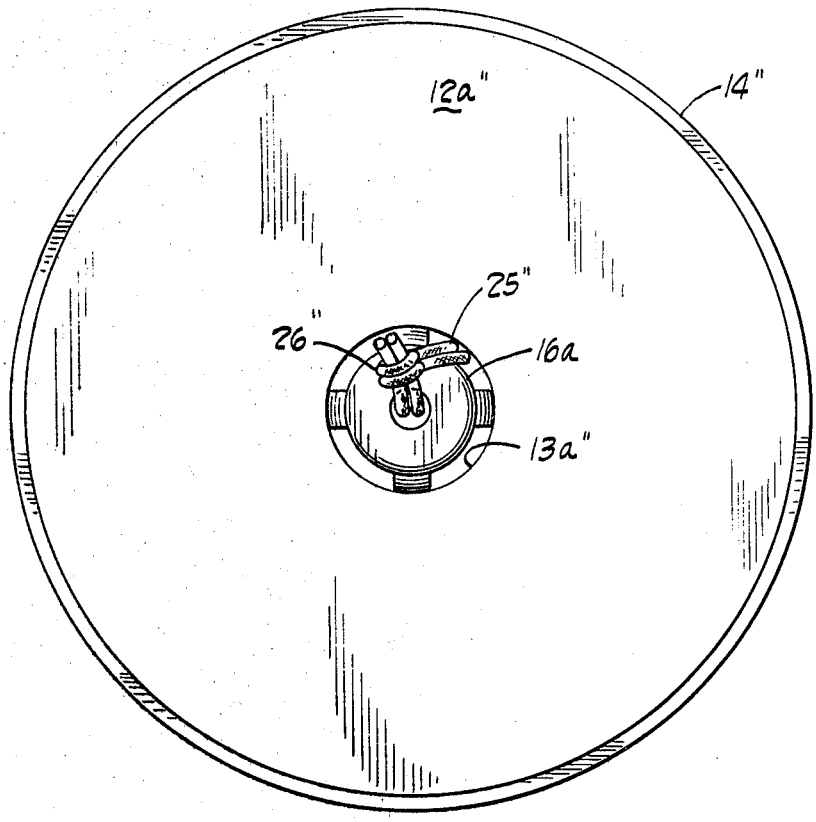
FIG. 5 is a view seen from the plane indicated by the line 5—5 in FIG. 4.

Alternatively, as shown in FIG. 4, a carrying handle 18″ may consist of a loop 25″ of cord attached at the free ends on the inside of the spindle 16″. An outer knot 26″ is positioned relatively close to the spindle 16″. The loop 25″ hangs loosely down the side of the spindle 16″ for loading. The spindle 16″ is cylindrical, having a diameter sufficiently smaller than a central opening 13*a*″ of a record 12*a*″, so that the record 12*a*″ may be loaded or unloaded over the spindle 16″ and the handle 18″. As is shown in FIG. 5, the spindle 16″ advantageously is formed in a grooved cylindrical shape, with a grooved slot 16*a* whose length extends axially along the length of the spindle 16. The grooved slot 16*a* accommodates the loop 25″ during loading and unloading. Alternatively, the spindle 16″ may be formed in a cylindrical shape of smaller diameter.

Modifications and variations of the invention will be apparent to those skilled in the art in light of the foregoing detailed disclosure. Therefore, it is to be understood that, within the scope of the appended claims, the invention can be practiced with other apparatus and in other manners than the specific apparatus disclosed herein without departing from the spirit of the invention.

What is claimed is:

1. An apparatus for carrying a stack of objects each of which has an aperture extending through it, the apparatus comprising:

(a) a base;

(b) a tubular spindle extending from said base, adapted for projection through the apertures of objects when said objects are stacked upon said base, said spindle having its extending end closed, said spindle having end portions of different external size the smaller of which is at the extending end of said spindle and said extending end has an aperture in its closed extending end and which said aperture is smaller than the interior of said spindle, said spindle having a larger end portion at said base and has its interior sized to receive the extending smaller end portion of another of said spindle whereby the extending end portion of said another spindle of a like apparatus can be inserted therein and like devices thus stacked one upon another;

(c) a retractable carrying handle extending through said aperture in said closed extending end of said spindle and being slidable therein and connected with said spindle by having enlarged portions within and without said spindle, said enlarged portions of said carrying handle being of greater size than said aperture in said closed extending end of said spindle and of smaller size than the exterior of said larger part of said spindle.

2. The apparatus of claim 1 wherein said carrying handle is an elongate loop of a flexible material and said enlarged portions are disposed adjacent opposite ends of said handle.

3. The apparatus of claim 1 wherein the portion of said carrying handle within the spindle includes means for retracting said carrying handle into said spindle.

4. The apparatus of claim 3 wherein the retracting means comprise a spring.

5. The apparatus of claim 3 wherein the retracting means comprise a weight.

6. The apparatus of claim 1 and further comprising a dust cover having an aperture therethrough conforming to the configuration of the exterior of said larger portion of said spindle and being slightly larger than the exterior thereof to fit over the handle and be slidable along said spindle whereby two carrying apparatus may be stacked without subjecting a dust cover on the lower carrying apparatus to the load of the upper carrying apparatus.

7. The apparatus of claim 1 wherein said spindle is provided with a slot-like groove extending axially along at least a portion of the periphery of the spindle from said extending end, and said handle is an elongate, flexible loop-like member which extends from said extending end of said spindle and is alternatively insertable into said groove for storage or removable from said groove for supporting said apparatus.

* * * * *